US005419725A

United States Patent [19]

Crowder et al.

[11] Patent Number: 5,419,725

[45] Date of Patent: May 30, 1995

[54] TRIGGERING MECHANISM

[75] Inventors: Kenneth L. Crowder, Marina del Rey; Lucas Willemse, Venice, both of Calif.

[73] Assignee: Deep Six Enterprises, Inc., Marina del Rey, Calif.

[21] Appl. No.: 108,484

[22] Filed: Aug. 17, 1993

[51] Int. Cl.[6] ..... B63B 22/14

[52] U.S. Cl. ..... 441/10; 441/41; 441/96

[58] Field of Search ..... 222/5, 3; 251/68.1, 251/233; 441/41, 30, 9, 10, 93, 94, 96, 99-101; 114/54, 367, 345

[56] References Cited

U.S. PATENT DOCUMENTS 3,934,292 1/1976 Mulderrig ..... 222/5

*Primary Examiner*—Edwin L. Swinehart

[57] ABSTRACT

The present invention utilizes low-friction, stepped triggering of successively higher-pre-loaded, counter-directed, nested stages in a compact configuration to efficiently multiply an input force. The present invention thus presents a novel force-multiplying mechanism for incorporation in any apparatus taking advantage of its ability to convert a force of a given magnitude into a force of greater magnitude. Such devices include, but are not limited to, those utilizing hydrostatic pressure for actuation of flotation, marking, and retrieval devices, those actuated by barostatic, mechanical, and pneumatic pressure, and those which trigger chemical (including pyrotechnic), electrical, mechanical, and pneumatic devices. There is theoretically no limit to the force multiplication inherent in the design, given the option of successive stages and ever-increasing driving forces.

7 Claims, 6 Drawing Sheets

FIG. 5
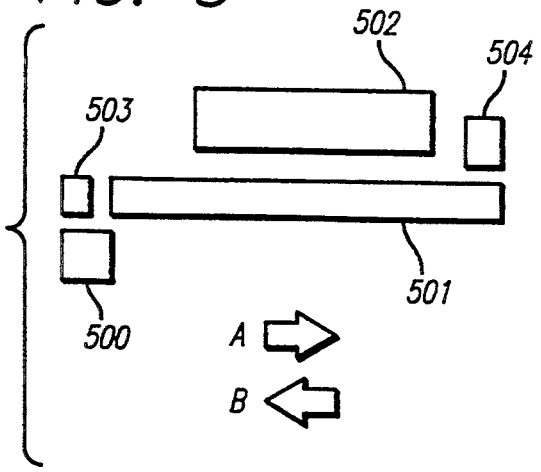
FIG. 6A
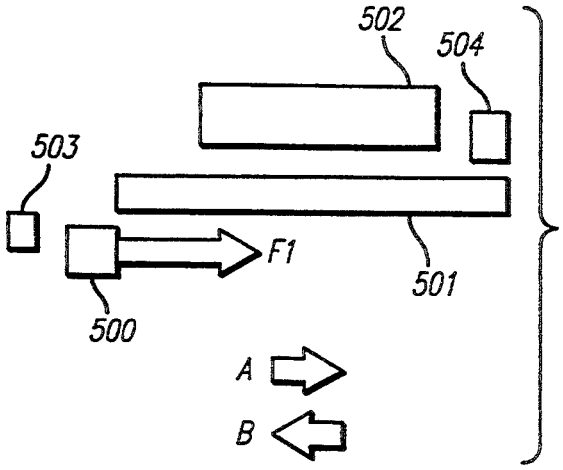
FIG. 6B
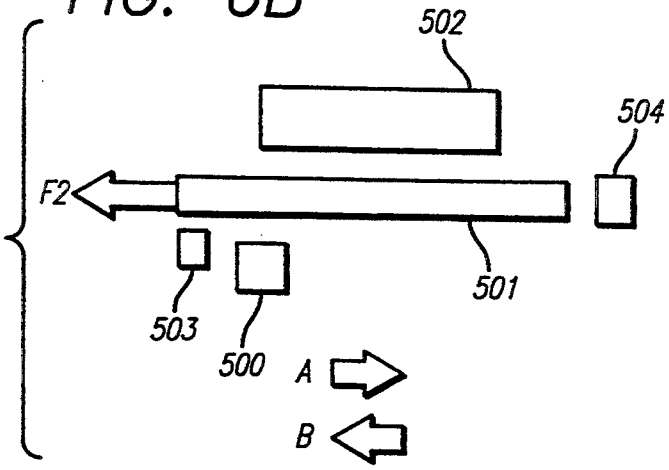
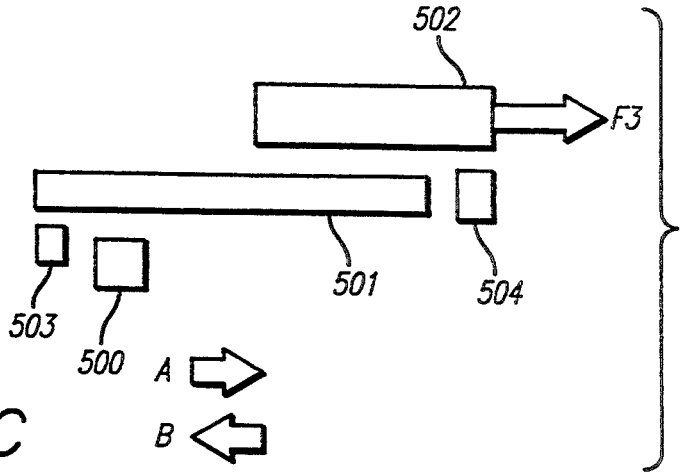
FIG. 6C

TRIGGERING MECHANISM

BACKGROUND OF THE INVENTION

1. Field of the Invention

This invention relates to the field of methods and apparatus for the multiplication of force.

2. Background Art

There are a number of situations and circumstances that require the multiplication of a first force into a second force. For example, it may be necessary to transform a relatively weak force into a relatively strong force. It may also be necessary to transform a large force into a smaller force. Such applications require a "force transformer" to accomplish the desired transformation. The force transformer includes a triggering mechanism for receiving a first force of a first level and actuating a transformation means, transformation means, and actuating means for applying a second force of a second level.

A force transformer that converts a small force into a larger force is referred to as a "force multiplier". A force multiplier converts a received force of a first low level into an output force of a second higher level. In many cases, the applied low level force is used as a triggering force to activate the force multiplier. The force multiplier, when activated, provides a higher level actuating force to perform a desired function. An example of a force-multiplying system is the power steering system of an automobile, which transforms the relatively low force arm movements of a driver to more powerful forces for turning the wheels of the car.

Other applications for force multipliers include those that rely on atmospheric, hydrostatic, or mechanical pressure to trigger the application of a large force. One such application involves the flotation, marking, and retrieval of inadvertently-submerged objects to which the device is attached based upon actuation by hydrostatic pressure corresponding to a preselected depth.

Automatic flotation devices employing hydrostatic pressure-activated mechanisms for initiation of inflation of flotation elements from compressed gas sources have been proposed for the flotation, marking, and retrieval of inadvertently-submerged objects. Among such objects considered for flotation have been relatively small items, such as fishing rods and reels and firearms. Among those considered for marking and retrieval have been relatively larger items, such as outboard motors and boats.

Such devices typically consist of a pressure sensing means, a gas storage means, a gas release means that is responsive to the pressure sensing means, and a bladder or balloon that is inflated with the released gas to provide buoyancy, causing the balloon to float to the surface, marking the position of the submerged object or lifting the submerged object to at or near the surface.

A common drawback in the designs of the various mechanisms proposed for such flotation, marking, and retrieval has been the size or the mechanical inefficiency of their actuation mechanisms. Initiation of the inflation sequence in any compressed gas device involves piercing a metal seal on the gas container supplying the inflation gas. The piercing of the seal requires, typically, a relatively high pre-loaded spring force to drive the piercing implement through the seal. Because the spring-loaded piercing mechanism must be restrained from moving before actuation by a force equal to that to which it has been loaded, a significant force is required at actuation to overcome the friction inherent in the restraining mechanism. Because the actuation force in a hydrostatically-activated apparatus is derived from its pressure-responsive diaphragm, and because the level of that force is directly related to the surface area of its diaphragm, the relatively high actuation forces required in compressed gas devices have caused such apparati to be of impractically or undesirably large size in order to ensure reliable actuation.

Prior art devices intended for the flotation of inadvertently-submerged objects and based upon hydrostatic actuation of inflation of flotation elements with compressed gas are described in Bannister U.S. Pat. No. 2,687,541, and Smith U.S. Pat. No. 2,853,724. The Bannister patent utilizes the mechanical advantage of a wedge design to spread the legs of a spring catch to trigger a spring-loaded piercing mechanism. The Smith patent employs an overcenter lever trigger design to the same effect. These prior art devices do not provide efficient gain in the force multiplier component. That is, the amount by which the force is multiplied is relatively small. As a result, the prior art devices are large, and not suited for applications where small size is a requirement. For example, a device for retrieving keys that are dropped into water should be small, so that a user can be comfortable carrying it. The prior art devices are not suitable for that application.

SUMMARY OF THE INVENTION

The present invention utilizes low-friction, stepped triggering of successively higher-pre-loaded, counter-directed, nested stages in a compact configuration to efficiently multiply an input force. The present invention thus presents a novel force-multiplying mechanism for incorporation in any apparatus taking advantage of its ability to convert a force of a given magnitude into a force of greater magnitude. Such devices include, but are not limited to, those utilizing hydrostatic pressure for actuation of flotation, marking, and retrieval devices, those actuated by barostatic, mechanical, and pneumatic pressure, and those which trigger chemical (including pyrotechnic), electrical, mechanical, and pneumatic devices. There is theoretically no limit to the force multiplication inherent in the design, given the option of successive stages and ever-increasing driving forces.

BRIEF DESCRIPTION OF THE DRAWINGS

FIG. 5 illustrates the force-multiplying stages of the present invention.

FIGS. 6A–6C illustrate the operation of the stages of FIG. 5.

DETAILED DESCRIPTION OF THE INVENTION

Figure 1:
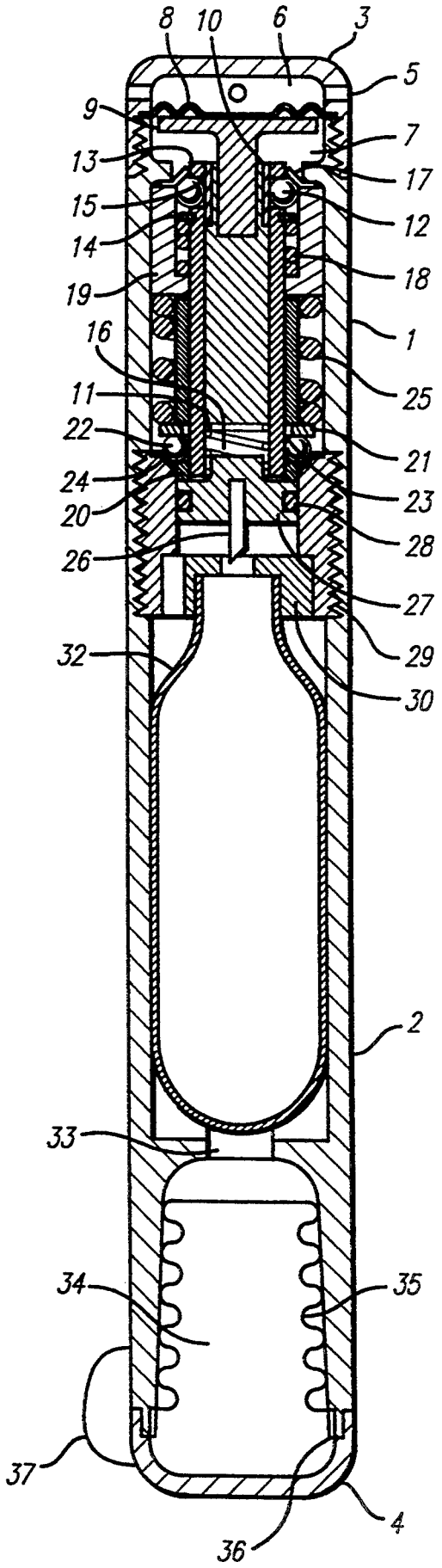
FIG. 1: Depicts the force multiplier in an automatic flotation device application in the pre-actuation configuration.

A force multiplier is described. In the following description, numerous specific details, such as component materials, spring constants, etc., are described in detail in order to provide a more thorough description of the present invention. It will be apparent, however, to one skilled in the art, that the present invention may be practiced without these specific details. In other instances, well known features have not been described in detail in order not to obscure the present invention.

FIG. 5 illustrates a functional block diagram of the invention in a two-stage configuration. The force multiplier utilizes stepped triggering of successively higher-pre-loaded stages to convert a relatively low input force into a relatively higher output force. One feature of the preferred embodiment of the present invention is the counter direction of the successive stages, which allows the stages to be nested within each other, thus reducing the dimensions of the apparatus and resulting in a smaller package for devices incorporating the force multiplier.

Referring to FIG. 5, the present invention is illustrated symbolically comprising an input force transmitter 500, first force-multiplier stage FX1 comprised of urged body 501 and first stage lock 503, and second stage force multiplier FX2 comprised of urged body 502 and second stage lock 504. For purposes of this example, forces act on the assembly in one of two directions A (from left of page to right of page) and B (from right of page to left of page).

The input force transmitter 500 is disposed adjacent to, and abuts, first stage FX1. The urged body 501 is biased by an urgent force in the B direction. First stage lock 503 prevents travel of urged body 501 in the B direction. First stage FX1 is wholly or partially nested within, and thus wholly or partially surrounded by, second stage FX2. Urged body 502 is biased by an urgent force in the A direction. Second stage lock 504 prevents travel of urged body 502 in the A direction.

FIG. 5 illustrates the present invention in its "locked", or "armed" mode. In this state, the invention is ready to react to an input, or triggering, force and multiply it into an actuating force, using first and second force-multiplying stages FX1 and FX2. The operation, at a functional level, of the invention is illustrated in FIGS. 6A–6C.

Referring first to FIG. 6A, a force F1, of a first force level, acts on input force transmitter 500, urging it in the A direction. This displacement of the input force transmitter in the A direction permits first stage lock 503 to unlatch, (shown symbolically as dropping out of the path of urged body 501) thereby unlocking the urgent force that acts upon urged body 501 so as to permit displacement of urged body 501 in the B direction.

Referring now to FIG. 6B, the first level of force-multiplying is illustrated. The urgent force acting on urged body 501 so as to bias it in the B direction now acts on urged body 501 with a force F2, greater than force Fl. Urged body 501, now free of lock 503, is displaced in the B direction. This displacement of urged body 501 permits second stage lock 504 to unlatch, thereby unlocking the urgent force that acts upon urged body 502 so as to permit displacement of urged body 502 in the A direction.

Referring now to FIG. 6C, the second level of force multiplying is illustrated. The urgent force acting on urged body 502 so as to bias it in the A direction now acts on urged body 502 with a force F3, greater than force F2. Urged body 502, now free of lock 504, is displaced in the A direction. The displacement of urged body 502 may now be used as an actuating force of F3 as desired. The result of the operation of FIGS. 6A–6C is that a force of F1 has been multiplied into a force of F3.

Although the example of FIGS. 5 and 6A–6C illustrate a two-stage force multiplier, the present invention also contemplates the cascading of a plurality of force-multiplying stages for ever-greater gain of force multiplication. One alternate embodiment utilizes a plurality of counterdirection and nested stages (where nested encompasses wholly or partially contained concentric stages). In another embodiment, nested stages of, for example, two stages, are disposed adjacent assemblies of nested stages so that the output of one stage acts as an input force to an input force transmitter of a subsequent stage.

Figure 7:
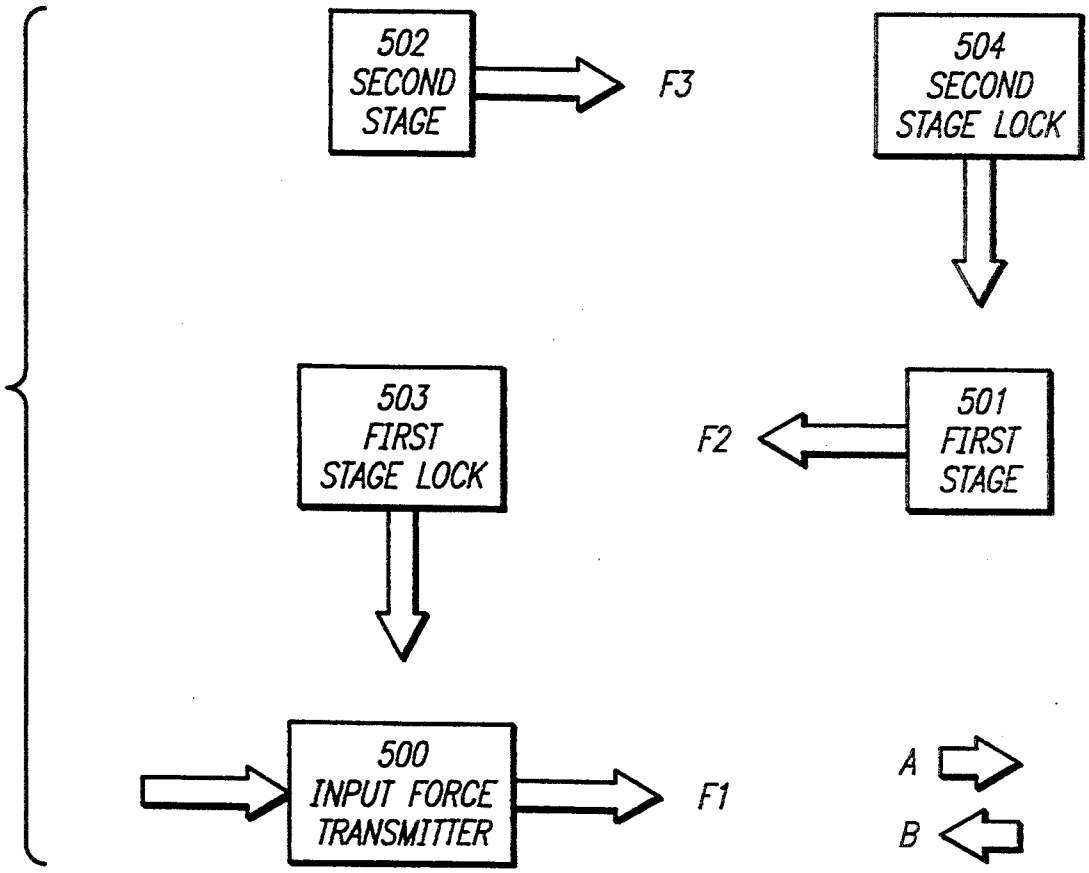
FIG. 7 symbolically illustrates the operation of the invention.

The operation of the invention is shown symbolically in FIG. 7. First stage 501 is urgently biased in the B direction with a force of F2, but is prevented from being displaced by first stage lock 503. First stage lock 503 is biased in the downward direction, but is blocked by input force transmitter 500. Second stage 502 is urgently biased in the A direction with a force F3. Displacement of second stage 502 is prevented by second stage lock 504. Second stage lock 504 is biased in the downward direction but is blocked by first stage 501.

When a force F1 acts on input force transmitter 500, it is displaced in the A direction. First stage lock 503, no longer blocked by input force transmitter 500, is displaced in the downward direction, so that first stage 501 is free to travel in the B direction, with a force F2. Second stage lock 504, now no longer blocked by first stage 501, is displaced in the downward direction, so that second stage 502 is free to travel in the A direction, with a force F3.

Flotation/Marking/Retrieval Device

A detailed view of one preferred embodiment of the force multiplier is illustrated in FIGS. 1–4 in connection with an example of a flotation/marking/retrieval device. This is presented by way of example only, as the force multiplier may be used in any desired application. The flotation/marking/retrieval device includes a hydrostatic pressure-sensing mechanism that corresponds to the input force transmitter 500 of FIG. 5. When the device is submerged in a liquid to a particular depth, hydrostatic pressure acting on the pressure-sensing mechanism initiates the two-stage force-multiplying action of the invention. The actuating force of the second stage is used to release compressed gas into a bladder, inflating the bladder and causing it to float to the surface of the liquid.

The flotation/marking/retrieval device can be manufactured in a small size and made to operate at shallow depths, due to the efficiency of the force multiplier. This permits the flotation/marking/retrieval device to be used in applications not previously practical. For example, the flotation/marking/retrieval device can be used as part of a key chain so that, if the keys are accidentally dropped into a body of water, even of a shallow depth, the activation of the device is triggered, inflating a bladder that floats to the surface, permitting easy location and retrieval of the dropped keys.

FIG. 1 depicts the flotation/marking/retrieval device in its pre-actuation configuration. The case, which may be comprised of a main housing 1 capped by a diaphragm chamber cap 3 connected by a housing connector 29 to a gas container/bladder housing 2 capped by a bladder chamber cap 4, may enclose a compressed gas container 32, a flotation bladder 35, and three principal assemblies: a pressure-sensing mechanism, a gas container piercing mechanism, and an inflation mechanism.

Compressed Gas Source

The gas container 32 may be any source of a suitable gas under pressure, and may be a commercially-available cylinder of carbon dioxide ($CO_2$). The gas container may incorporate a relatively thin-walled segment intended to be pierced by a sharp implement driven by a mechanism actuated by hydrostatic pressure, so as to release the gas contained therein.

Flotation Bladder

The flotation bladder 35 may be fashioned of any suitable expandable or non-expandable flexible material folded within a bladder chamber 34. The bladder chamber may be formed and enclosed by a hollow portion of case section 2 and bladder chamber cap 4. The bladder chamber cap may be releasably attached to the bladder chamber by any suitable means, including a friction, or snap, fit, which yields to the expansion pressure applied to it from within by the inflating bladder and opens, permitting the escape and full expansion of the flotation bladder.

The gas container, the flotation bladder, and the bladder chamber may be varied in size, shape, and material composition to adapt to any desired flotation, marking, or retrieval application.

Pressure-Sensing Mechanism

The pressure-sensing mechanism of the flotation/-marking/retrieval device corresponds to the component described as the input force transmitter 500 of FIG. 5. The pressure-sensing mechanism, together with the trigger and firing mechanisms of the gas container piercing mechanism (described below), comprise the force multiplier of the flotation/marking/retrieval device. The pressure-sensing mechanism supplies relatively low input force hydrostatic pressure (F1) to the (first stage) force-multiplying trigger mechanism, which upon actuation by F1 supplies a greater force (F2) to the (second stage) force-multiplying firing mechanism, which upon actuation by F2 supplies the gas container piercing force (F3). The pressure-sensing mechanism comprises a cap 3, incorporating inlet holes 5 or other access for liquid, whose inner cavity forms an actuation pressure chamber 6; a case section 1, whose inner cavity oriented toward the actuation pressure chamber forms a portion of the sealed chamber 7; a flexible or movable diaphragm or bellows 8 suspended between and isolating from one another the actuation pressure chamber and the sealed chamber; and a diaphragm plate 9 affixed to or contiguous to the diaphragm in the sealed chamber.

Upon submergence of the device and the entry of water into the actuation pressure chamber 6, the diaphragm 8 is displaced against the diaphragm plate 9 in response to increasing pressure within that chamber. As will be seen, the movement of the diaphragm plate actuates the trigger mechanism at a pressure corresponding to a preselected depth to initiate inflation and flotation.

Gas Container Piercing Mechanism

The gas container piercing mechanism of the flotation/marking/retrieval device is comprised of trigger mechanism and firing mechanism sub-assemblies that correspond, respectively, to the components described as the first (FX1) and second (FX2) force-multiplying stages of FIG. 5.

Trigger Mechanism

The trigger mechanism of the flotation/marking/retrieval device corresponds to the combination of components described as the first force-multiplying stage FX1 of FIG. 5. The trigger mechanism converts the relatively low force hydrostatic pressure (F1) acting on the input force transmitter into a higher force (F2) which triggers the firing mechanism.

The trigger assembly comprises the following components: a trigger pin 10 which slidingly rides on locks 12 within a recess 16 in a trigger sleeve 13; an angled trigger sleeve seat 17 retained within the inner wall of the main housing 1; a trigger pin compression spring 11 positioned in the trigger sleeve recess between the trigger pin and the inside end of the recess; and a trigger sleeve compression spring 18 situated within a spring spacer 19 and concentric to and contacting the trigger sleeve at an outer shoulder 14 thereof. The trigger sleeve locks 12 are positioned within cutouts 15 in the wall of the trigger sleeve and are in contact with the trigger pin, the trigger sleeve, and the trigger sleeve seat.

The trigger locks 12 may be implemented as bearings, spheres, pins, blocks, cylinders, truncated pyramids, or any other suitable element and may either roll, or slide, or both, along the adjacent trigger pin.

The trigger pin 10 rides against the trigger pin spring 11, whose functions are to provide a selection of actuation depth and a margin of safety against inadvertent actuation of the device caused by inadvertent movement of the trigger pin, as might otherwise possibly occur if the device were dropped. The desired depth actuation option thereby provided may be selected by specification of the trigger pin spring rate.

The trigger sleeve spring 18 is compressed between the spring spacer 19 and the trigger sleeve shoulder 14. The trigger sleeve 13 is locked against movement, as urged by the trigger sleeve spring in the direction of the diaphragm 8, by the trigger sleeve locks 12, which in turn are locked against movement by entrapment between the trigger pin, the trigger sleeve, and the trigger sleeve seat 17.

Until the pressure working against the diaphragm, diaphragm plate, and trigger pin has increased to a level sufficient to move the trigger pin deeply enough into the trigger sleeve recess to allow the trigger sleeve locks to move in behind the trigger pin, the trigger pin will maintain the locks in place between the firing pin and the trigger sleeve seat, thereby locking the trigger sleeve against movement as urged by the trigger sleeve spring.

Firing Mechanism

The firing mechanism corresponds to the combination of components described as the second force-multiplying stage FX2 of FIG. 5. The firing mechanism multiplies the output force (F2) of the trigger mechanism to a higher output force (F3) used to pierce the gas container.

The piercing assembly consists of the following components: a hollow striker sleeve 20 in which the trigger sleeve 13 slidingly rides on striker sleeve locks 22; an angled striker sleeve seat 24 retained within the inner wall of the main housing 1; a striker sleeve compression spring 25 concentric to and contacting the striker sleeve at an outer shoulder 21 thereof; and a piercing pin 26 within a piercing pin body 27 incorporating an O-ring 28 or other device suitable for isolation of the chambers on either side thereof. The striker sleeve locks are positioned within cutouts 23 in the wall of the striker sleeve and are in contact with the trigger sleeve, the striker sleeve, and the striker sleeve seat.

The striker sleeve spring 25 is compressed between the spring spacer 19 and the striker sleeve shoulder 21. The striker sleeve 20 is locked against movement, as urged by the striker sleeve spring in the direction of the piercing pin body 27, by the striker sleeve locks 22, which in turn are locked against movement by entrapment between the trigger sleeve 13, the striker sleeve, and the striker sleeve seat 24.

Inflation Mechanism

The inflation mechanism consists of the following components: a gas container 32 with spacer and manifold 30; an inflation manifold 33 through which the gas passes to the flotation bladder 35, which is retained to the bladder chamber by a bladder retaining ring 36; and the openable bladder chamber 34.

Operation of Flotation/Marking/Retrieval Device

Figure 2:
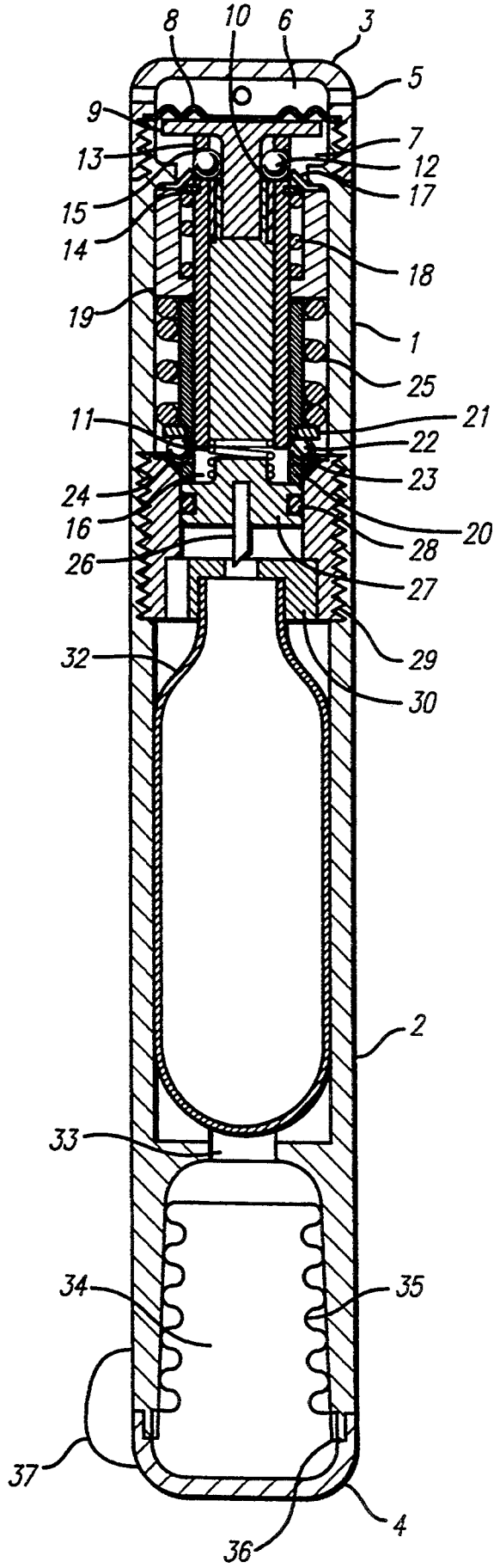
FIG. 2: Depicts the configuration of the components of the force multiplier assembly upon actuation, with first-stage (trigger) function complete.

FIG. 2 depicts the apparatus upon initial actuation at the preselected depth. At the preselected depth, the pressure within the actuation pressure chamber 6 acting on the diaphragm 8 has attained a level sufficient to overcome the resistance of the trigger pin spring 11 and move the trigger pin 10 deeply enough into the trigger sleeve recess 16 to allow the trigger sleeve locks 12, urged by the force applied by the trigger sleeve spring 18 through the locks against the angled surface of the trigger sleeve seat 17, to move out of their locking position and to fall in behind the trigger sleeve.

Figure 3:
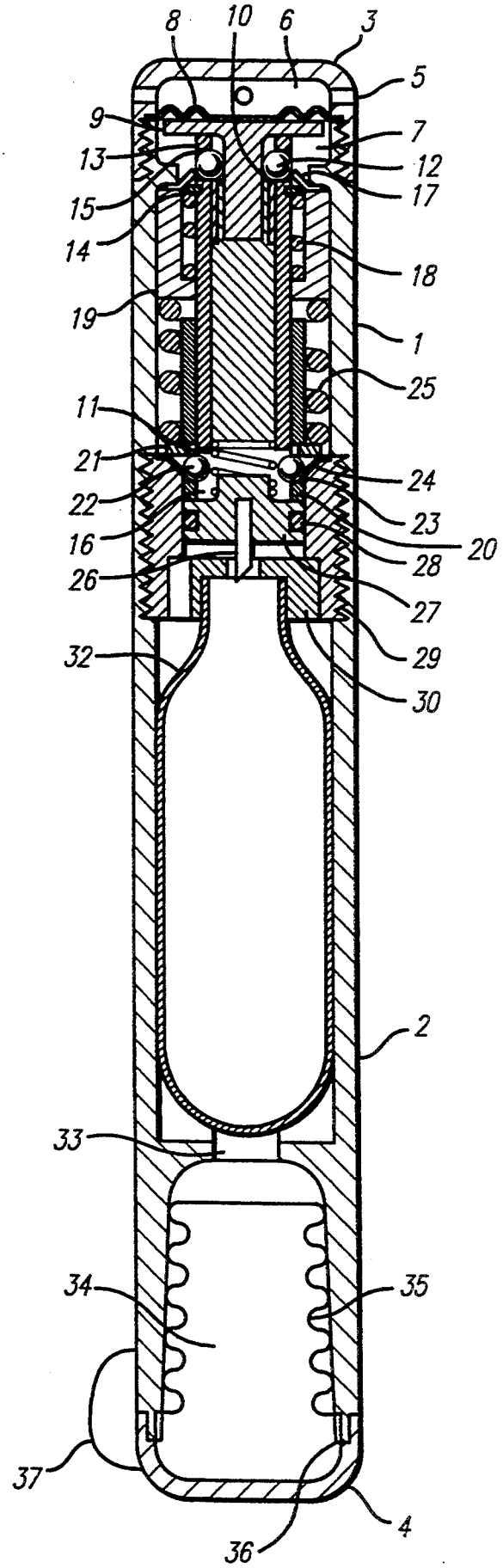
FIG. 3: Depicts the configuration of the force multiplier components with second-stage (firing) function complete.

Referring now to FIG. 3, the second stage is illustrated. The movement of the trigger sleeve locks 12 allows the trigger sleeve 13 to move, as urged by its spring, in the direction of the diaphragm 8. The movement of the trigger sleeve 13 allows the striker sleeve locks 22 to move out of their locking position and to fall in behind the trigger sleeve, thereby allowing the striker sleeve spring 25 to urge the striker sleeve 20 into the piercing pin body 27 and, thereby, the piercing pin 26 into the gas container 32, initiating the inflation sequence.

Figure 4:
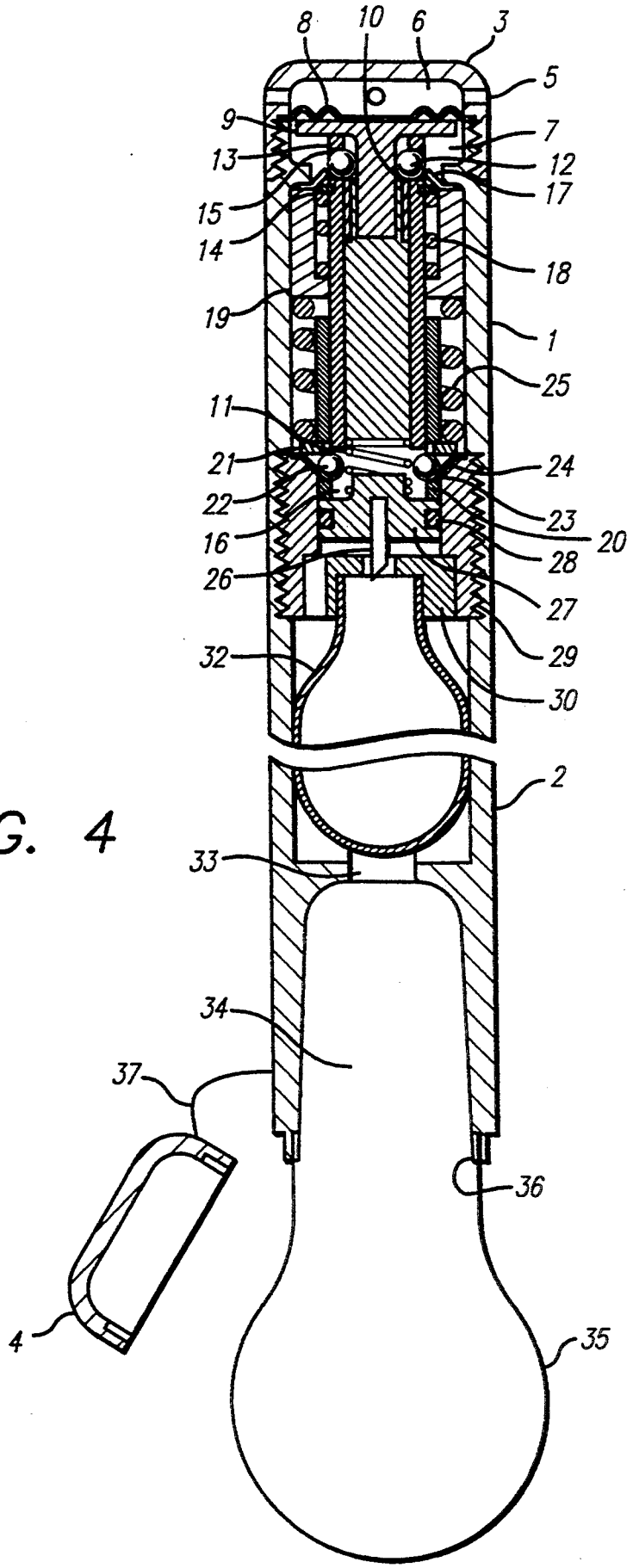
FIG. 4: Depicts the flotation device in the post-actuation configuration, with flotation bladder deployed and mechanical function complete.

The inflation of the flotation bladder is illustrated in FIG. 4. Upon release from the gas container 32, the gas flows through the inflation manifold 33 and into the flotation bladder 35. The inflation of the bladder 35 causes the expansion pressure thereof to be exerted against the inner wall of the bladder chamber cap 4, overcoming the closure friction between the cap and the chamber lip, allowing the bladder to escape and expand fully. The bladder chamber cap is retained to the body of the device by a tether 37. The apparatus and the object to which it is attached then ascend to the surface.

Thus, a force multiplier has been described.

We claim:

1. A triggering mechanism comprising:

an input force transmitter for supplying a force of F1 acting in a first direction;

a first triggering stage disposed adjacent to and abutting said input force transmitter, said first triggering stage incorporating a first urged body biased in a second direction opposite said first direction;

first stage locking means incorporated in said first triggering stage for preventing displacement of said first urged body in said second direction;

a second triggering stage disposed adjacent to said first triggering stage, said second triggering stage incorporating a second urged body biased in said first direction;

second stage locking means incorporated in said second triggering stage for preventing displacement of said second urged body in said first direction.

2. The triggering mechanism of claim 1 wherein said first urged body is biased in said second direction with a force F2, where force F2 is greater than force F1.

3. The triggering mechanism of claim 2 wherein said second urged body is biased in said first direction with a force F3, where force F3 is greater than force F2.

4. A method of triggering a device comprising the steps of:

providing an input force transmitter for transmitting a force of F1 acting in a first direction;

providing a first triggering stage disposed adjacent to and abutting said input force transmitter, said first triggering stage incorporating a first urged body biased in a second direction opposite said first direction;

providing a first stage locking means incorporated in said first triggering stage for preventing displacement of said first urged body in said second direction;

providing a second triggering stage disposed adjacent to said first triggering stage, said second triggering stage incorporating a second urged body biased in said first direction;

providing a second stage locking means incorporated in said second triggering stage for preventing displacement of said second urged body in said first direction;

applying said force F1 to said input force transmitter so that said input force transmitter is displaced in said first direction, thereby releasing said first stage locking means and displacing said first urged body in said second direction with a force F2;

displacing said first urged body in said second direction with a force F2 when said first stage locking means are released, thereby releasing said second stage locking means and displacing said second urged body in said first direction with a force F3.

5. A device for triggering a force, comprising: two or more sleeves of successively greater cross-section dimension, with each sleeve urged in successively opposite direction by associated urging means of successively greater force, each sleeve having an associated sleeve wall, with the movement of each sleeve triggered by the movement of the preceding sleeve: the sleeves comprising various shapes in cross-section along their lengths such that they move inside and over one another with minimal impediment; the urging means comprising any source of force or pressure, pre-loaded to exert force against each sleeve; until triggered, each sleeve selectably locked against movement by the presence of a locking means in a cutout in the associated sleeve wall which is pinned between the edge of the cutout, the outer surface of the preceding sleeve, and a surface angled to urge the locking means, upon movement of the preceding sleeve out from under the locking means, down and out of the cutout, allowing the urging means to move the sleeve.

6. A device for triggering a force, comprising: a trigger pin positioned within, and capable of moving axially within, a trigger sleeve positioned within, and capable of moving axially within, a striker sleeve having an associated sleeve wall; the trigger pin is urged by actuation force to move deeper into the trigger sleeve; the trigger sleeve is urged by a first spring to move in the direction opposite that of the trigger pin; the striker sleeve is urged by a second spring to move in the direction opposite that of the trigger sleeve; until actuation of the device, the striker sleeve, which applies the task-intended force, is locked against movement by the presence of locking means in cutouts in the associated sleeve wall which are pinned between the edges of the cutouts, the outer surface of the trigger sleeve, and a seat angled to urge the locking means, upon movement of the trigger sleeve out from under them, down and out of the cutouts, allowing the striker sleeve spring to move the striker sleeve and apply the force; until actuation of the device, the trigger sleeve is locked against movement by the presence of locking means in cutouts in the sleeve wall which are pinned between the edges of the cutouts, the outer surface of the trigger pin, and a seat angled to urge the locking means, upon movement of the trigger pin out from under them, down and out of the cutouts, allowing the trigger sleeve spring to move the trigger sleeve and thereby trigger the striker sleeve; the trigger sleeve and the striker sleeve are thus unlocked to move by the movement of the trigger pin in response to an actuation force.

7. A flotation device for floating, marking, and retrieving inadvertently-submerged objects, comprising: (a) an outer casing capable of attachment to the object to be floated, marked, or retrieved; (b) a depth-sensing mechanism comprising a flexible bellows or diaphragm suspended between and isolating (1) an actuation pressure chamber equipped with passages to admit the entry of water when submerged and (2) a sealed chamber, with the diaphragm acting against a trigger pin on the side of the diaphragm opposite the actuation pressure chamber, such that the hydrostatic pressure developed with depth in the actuation pressure chamber acts on the diaphragm and, thus, on the trigger pin, to actuate a gas container piercing mechanism; (c) a gas container piercing mechanism employing a triggering mechanism which drives a piercing pin into the gas container to effect release of the inflation gas when triggered by the depth-sensing mechanism, comprising: a trigger pin positioned within, and capable of moving axially within, a trigger sleeve positioned within, and capable of moving axially within, a striker sleeve having an associated sleeve wall; the trigger pin is urged by hydrostatic pressure to move deeper into the trigger sleeve; the trigger sleeve is urged by a first spring to move in the direction opposite that of the trigger pin; the striker sleeve is urged by a second spring to move in the direction opposite that of the trigger sleeve; until actuation of the device at the preselected depth, the striker sleeve, which applies the gas container piercing force, is locked against movement by the presence of locks in cutouts in the associated sleeve wall which are pinned between the edges of the cutouts, the outer surface of the trigger sleeve, and a seat angled to urge the locks, upon movement of the trigger sleeve out from under them, down and out of the cutouts, allowing the striker sleeve spring to move the striker sleeve and pierce the gas container; until actuation of the device, the trigger sleeve is locked against movement by the presence of locks in cutouts in the sleeve wall which are pinned between the edges of the cutouts, the outer surface of the trigger pin, and a seat angled to urge the locks, upon movement of the trigger pin out from under them, down and out of the cutouts, allowing the trigger sleeve spring to move the trigger sleeve and thereby trigger the striker sleeve, effecting release of the inflation gas; (d) an inflation mechanism comprising a manifold system and a flotation bladder folded within an openable chamber from which the bladder is released by the force of its expansion therewithin.

* * * * *